US005423656A

United States Patent [19]

Filsinger et al.

[11] Patent Number: 5,423,656

[45] Date of Patent: Jun. 13, 1995

[54] DEVICE FOR JOGGING A PILE

[75] Inventors: Karl-Heinz Filsinger, Wiesloch; Roland Hirth, Römerberg, both of Germany

[73] Assignee: Heidelberger Druckmaschinen AG, Heidelberg, Germany

[21] Appl. No.: 78,415

[22] Filed: Jun. 17, 1993

[30] Foreign Application Priority Data

Jun. 19, 1992 [DE] Germany ..... 42 20 074.1

[51] Int. Cl.[6] ..... B65H 9/06

[52] U.S. Cl. ..... 414/788; 271/221; 271/223; 414/789.1; 414/907

[58] Field of Search ..... 271/220, 221, 222, 223, 271/224; 414/788, 907, 789.1

[56] References Cited

U.S. PATENT DOCUMENTS 2,060,270 11/1936 Willats et al. .
3,693,970 9/1972 Grobman .
5,226,642 7/1993 Ganter ..... 271/222

FOREIGN PATENT DOCUMENTS 1242635 6/1967 Germany .
2138628 4/1972 Germany .
7513266 8/1976 Germany .
2939267 4/1981 Germany .
134466 6/1988 Japan ..... 271/224
1109724 4/1968 United Kingdom .

*Primary Examiner*—Michael S. Huppert
*Assistant Examiner*—Janice L. Krizek
*Attorney, Agent, or Firm*—Herbert L. Lerner; Laurence A. Greenberg

[57] ABSTRACT

Device for jogging a pile of sheets includes a pushrod extending in a direction towards a sheet pile, the pushrod having a thrust plate disposed on an end thereof pointing in the direction towards the sheet pile, a device for holding the pushrod, the holding device being displaceable in a jogging direction, a drive connectible to the holding device for imparting a jogging movement thereto in the jogging direction, the pushrod being mounted so as to be displaceable in the direction towards the sheet pile for adjusting the position of the thrust plate relative to the holding device, an adjusting device for adjusting the pushrod in position for effecting a format adjustment, the pushrod being variable in length, a device for varying the length of the pushrod, and a device for fixing the pushrod at and for releasing the pushrod from a respective length thereof.

4 Claims, 6 Drawing Sheets

DEVICE FOR JOGGING A PILE

The invention relates to a device for jogging a pile and, more particularly, to such a device having a pushrod extending in the direction of the pile with a thrust plate disposed on an end thereof pointing in the pile direction, and having a holder displaceable in jogging direction and connected to drive means for performing the jogging movement, the pushrod, for the purpose of adjusting the position of the thrust plate relative to the holder, being mounted so as to be displaceable in the pile direction and adjustable in the position thereof for effecting a format adjustment.

Such a device has become known heretofore from German Utility or Petty Patent 75 13 266. To align a pile, plates attached to jogging or thrust rods are repeatedly reciprocated against the pile. The reciprocating movement is transmitted by a cam drive to a bearing bushing displaceably mounted opposite a side frame of the printing press. A jogging rod formed as a spindle is mounted in the bearing bushing so as to be adjustable in the position thereof. For format adjustment, the jogging rod, in the position thereof with respect to the bearing bushing, is displaced in the bearing bushing.

There is provided, in accordance with the invention, a device for jogging a pile of sheets, comprising a pushrod extending in a direction towards a sheet pile, the pushrod having a thrust plate disposed on an end thereof pointing in the direction towards the sheet pile, means for holding the pushrod, the holding means being displaceable in a jogging direction, drive means connectible to the holding means for imparting a jogging movement thereto in the jogging direction, the pushrod being mounted so as to be displaceable in the direction towards the sheet pile for adjusting the position of the thrust plate relative to the holding means, adjusting means for adjusting the pushrod in position for effecting a format adjustment, the pushrod being variable in length, means for varying the length of the pushrod, and means for fixing the pushrod at and for releasing the pushrod from a respective length thereof.

By varying the length of the pushrod, a relatively small sheet format can be processed with a pushrod of relatively great length. For relatively large sheet formats, processing thereof may be effected with a pushrod of relatively short length. It is thereby possible that, even for very large sheet formats, with a stable or sturdy mounting support for the pushrod, the latter does not penetrate with excessive space-consumption into the outer space beyond the press frame. It is possible to install such a device without difficulty even in the narrowest of spaces. The pushrod according to the invention offers no additional safety risks to personnel, so that any additional and likewise space-wasting and restrictive protective coverings or casings can be dispensed with.

In accordance with another feature of the invention, the pushrod comprises a plurality of telescoping rods mounted so as to be displaceable in one another in the direction towards the sheet pile, the means for varying the length of the pushrod being actuatable for, respectively, telescopically extending and retracting the telescoping rods. This especially simple construction of the device according to the invention effects, with relatively small outlay, a functionally reliable alignment of a sheet pile over a relatively large range of format adjustments. A stable mounting support can be maintained over the entire range of sheet formats.

In accordance with a further feature of the invention, the plurality of telescoping rods include an inner rod formed as a toothed rack, and an outer rod formed with a slot in vicinity of the teeth of the toothed rack, and a gear drive having a gear in continuous working contact with the toothed rack through the slot for forming between the inner and the outer rod a respectively releasable and restorable operative connection for entraining the outer rod. An especially advantageous and reliable format adjustment may be effected with such a construction of the device according to the invention.

In accordance with an added feature of the invention, the means for varying the length of the pushrod are also the adjusting means for adjusting the pushrod in position. This construction of the device according to the invention is especially simple and space-saving. With a common drive means, the pushrod can thus be adjusted in position with respect to the holding means and be varied in length.

In accordance with a concomitant feature of the invention, the means for varying the length of the pushrod are disposed on the means for holding the pushrod. This provides a relatively simple construction of the means for varying the length of the pushrod. Because the means for varying the length of the pushrod are closely associated with or follow the jogging movement in such a device, they can be operatively connected continuously with the pushrod without requiring any additional costly space-robbing coupling elements.

Other features which are considered as characteristic for the invention are set forth in the appended claims.

Although the invention is illustrated and described herein as embodied in a device for jogging a pile, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1*a* is a diagrammatic front elevational view of a jogging device according to the invention arranged in a sheet-fed printing press;

FIG. 1*b* is a diagrammatic side elevational view of the jogging device mounted in press side frames shown in section;

Figure 1B:
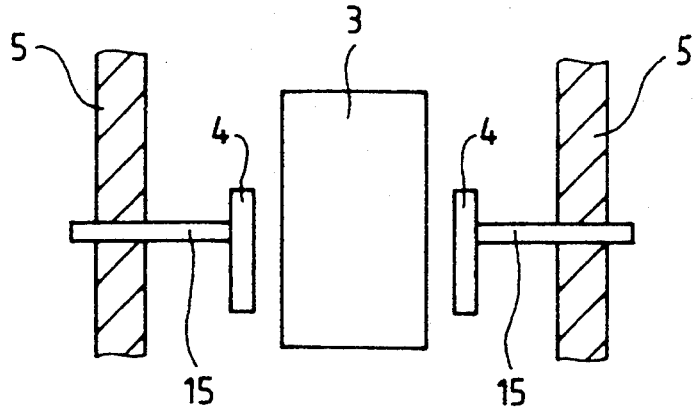
Figure 1A:
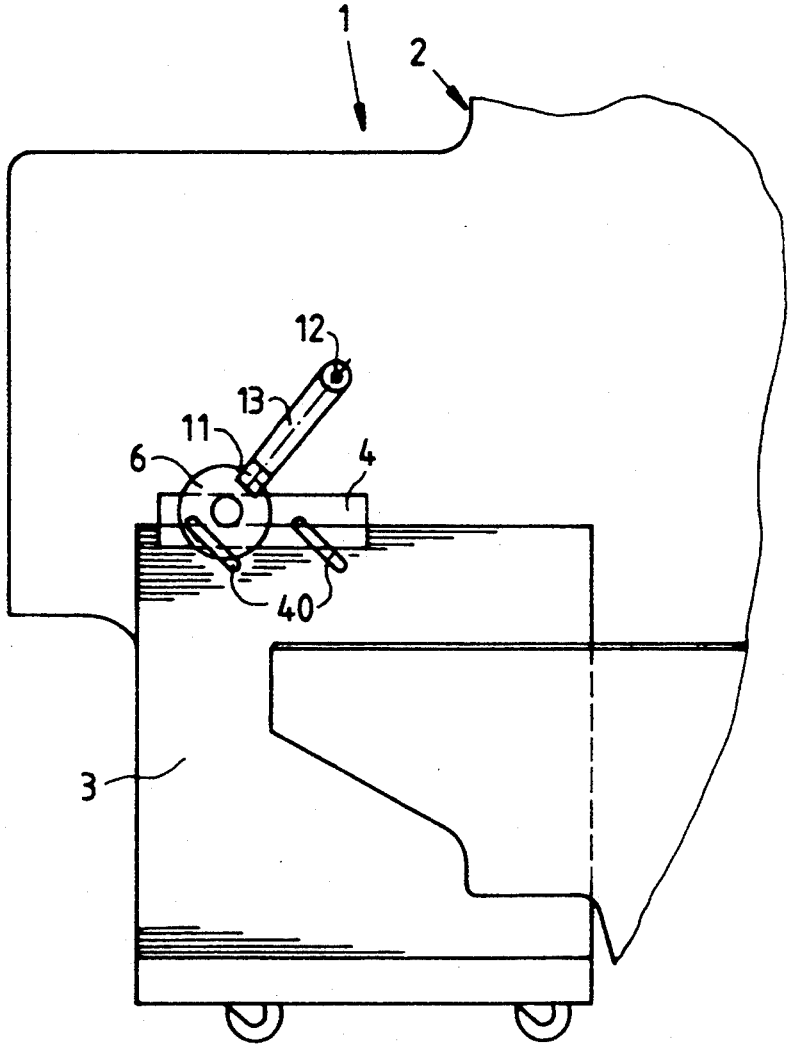

Referring now to the drawings and, first, particularly to FIG. 1*a* thereof, a delivery 1 of a sheet-fed offset printing press is shown therein located downstream from a final printing unit 2 of the press, as viewed in the sheet travel direction. Paper sheets deposited on a delivery pile 3 are aligned in a lateral position by means of toothed racks 15 (note FIG. 1*b*, for example) which are displaceably disposed in a direction in which the pile is being formed, the toothed racks being attached to holders 40 having jogging plates 4 linked thereto.

Figure 2:
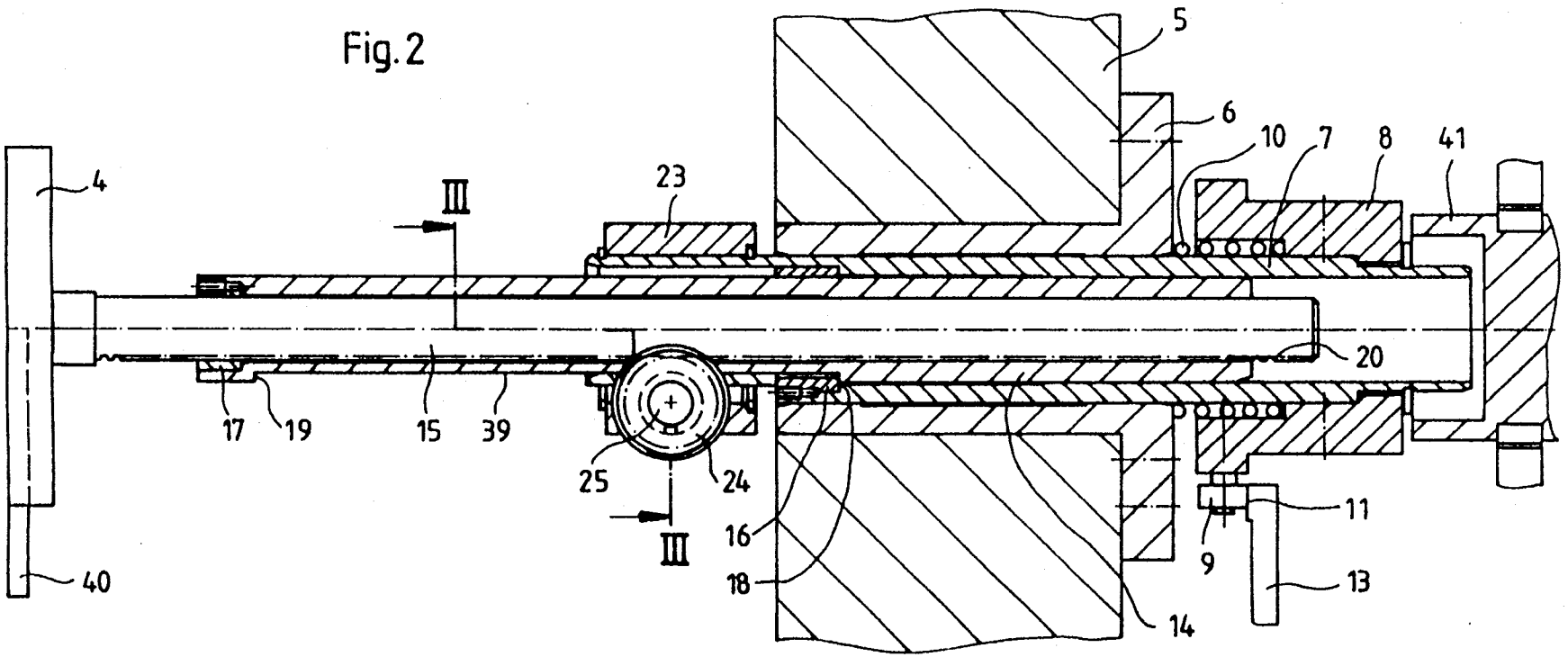
FIG. 2 is a much enlarged fragmentary view of FIG. 1*b* showing the right-hand part of the jogging device in great detail.
Figure 3:
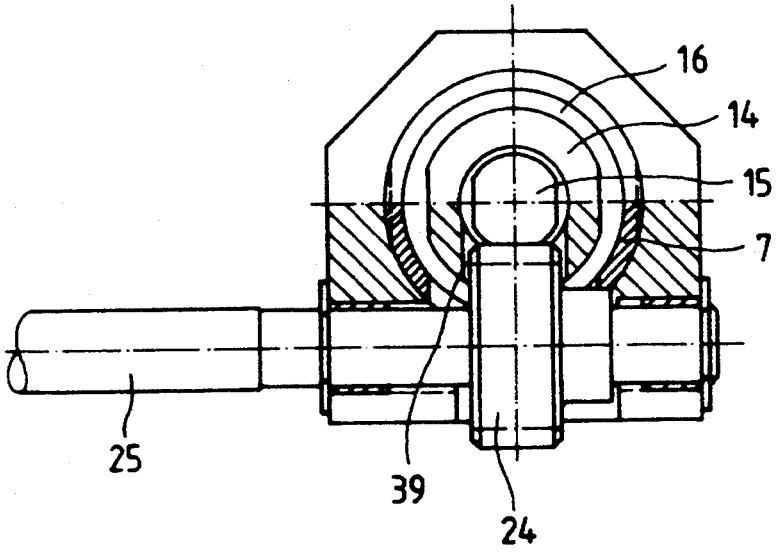
FIG. 3 is a cross-sectional view of FIG. 2 taken along the line III—III in the direction of the arrows.

As shown in FIGS. 1*a*, 2 and 3, each of the profiled or toothed racks 15 is displaceably mounted in a hollow shaft 14. The respective toothed rack 15 is mounted, in a manner that it is axially displaceable yet fixed against relative rotation with the hollow shaft 14, in a guide bushing 17 fastened in the hollow shaft 14 and formed with an inner profile corresponding to the outer profile of the toothed rack 15. The hollow shaft 14 is formed with a slot 39 extending parallel to the longitudinal axis thereof and having stop surfaces 18 and 19 formed at respective ends thereof.

The hollow shaft 14 is also mounted in a hollow shaft 7 so as to be axially displaceable yet fixed against relative rotation therewith, the hollow shaft 7, in turn, being mounted in a bearing bushing 6 fastened in a side wall 5 of the press. Both of the hollow shafts 7 and 14, as well as the toothed rack 15, are disposed coaxially with one another. The hollow shaft 14 is profiled at the outer cylindrical surface thereof and is mounted, so as to be axially displaceable yet fixed against relative rotation, in a bushing 16 fastened in the hollow shaft 7 and being formed with an inner profile corresponding to the outer profile of the hollow shaft 14.

Figure 4:
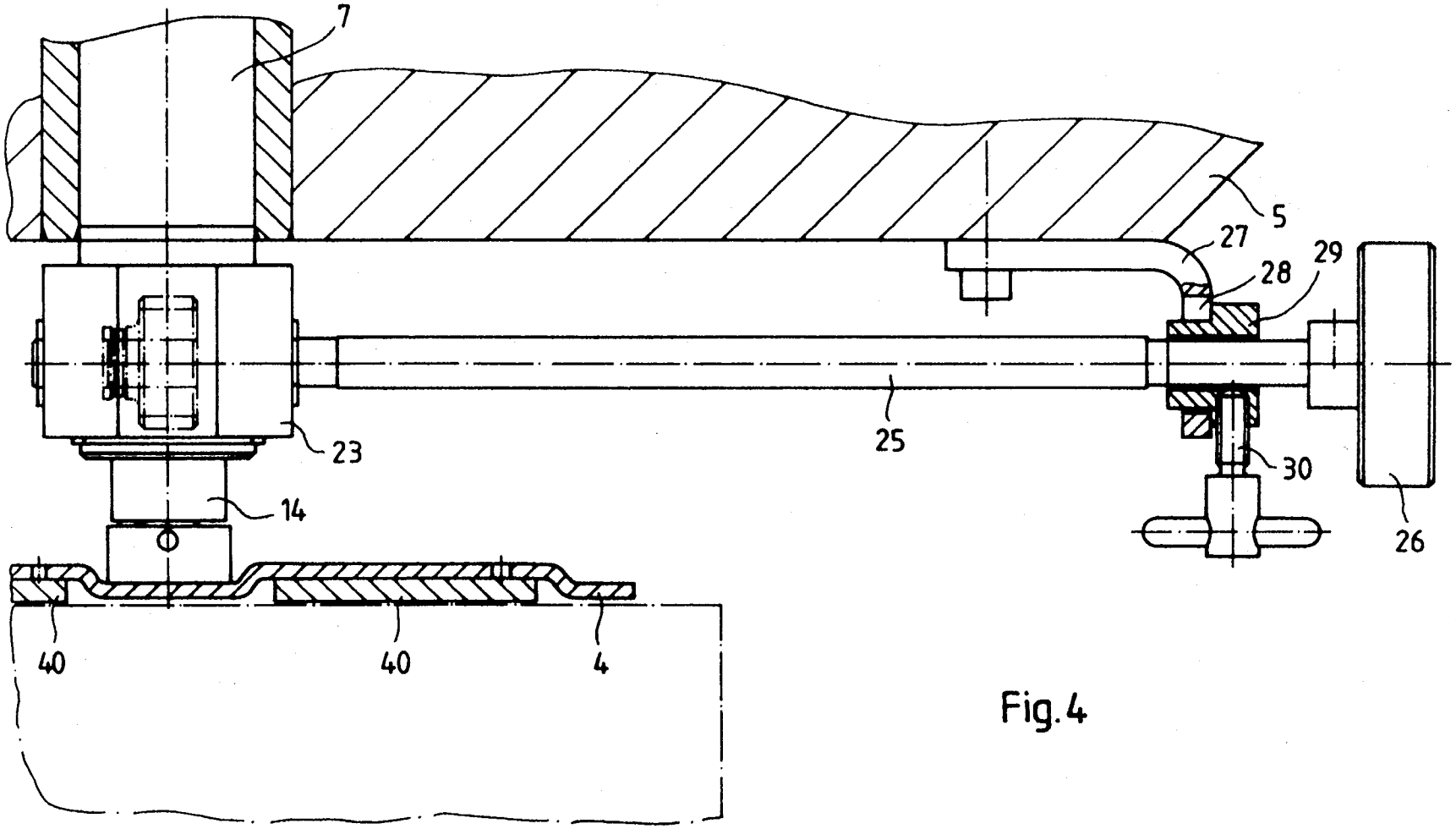
FIG. 4 is an enlarged, fragmentary top plan view, partly in section and rotated through an angle of 90 degrees, of FIG. 2, in another operating phase of the jogging device according to the invention, and showing an adjusting mechanism of the device in greater detail.

A bearing block 23 is fastened on an end region of the hollow shaft 7 which is directed from the side wall 5 towards the side of the pile 3. An adjusting shaft 25 is rotatably mounted in the bearing block 23 below the toothed rack 15 and fixed against axial displacement. A gear 24 is fastened to the adjusting shaft 25 and, through a slot formed on the hollow shaft 7 and the slot 39 formed in the hollow shaft 14 and aligned therewith, meshes with the toothed rack 15. As shown in FIG. 4, the adjusting shaft 25 is disposed perpendicularly to the axis of the toothed rack 15 and, at an end thereof disposed opposite to or away from the gear 24 is mounted so as to be rotatable in a bearing bushing 29, yet fixed against axial displacement relative thereto. The bearing bushing 29 is mounted, so as to be fixed against rotation relative to and displaceable in a direction parallel with the axis of the toothed rack 15, in a slot 28 serving as a slide bearing in a holding lug 27 fastened to the side wall 5. A hand wheel 26 is mounted at the end of the adjusting shaft 25 extending through the bearing bushing 29. By means of a locking or set screw 30, the adjusting shaft 25 can be locked in a set rotary position with respect to the bearing bushing 29.

As shown in FIG. 2, an entrainer disc 8 is fastened on the end of the hollow shaft 7 extending through the side wall 5 and directed away from the delivery pile 3. An entrainer roller 9 is rotatably mounted radially to the hollow shaft 7 at the peripheral surface of the entrainer disc 8. A compression spring 10 is coaxially mounted on the hollow shaft 7 between the entrainer disc 8 and the bearing bushing 6.

Figure 6:
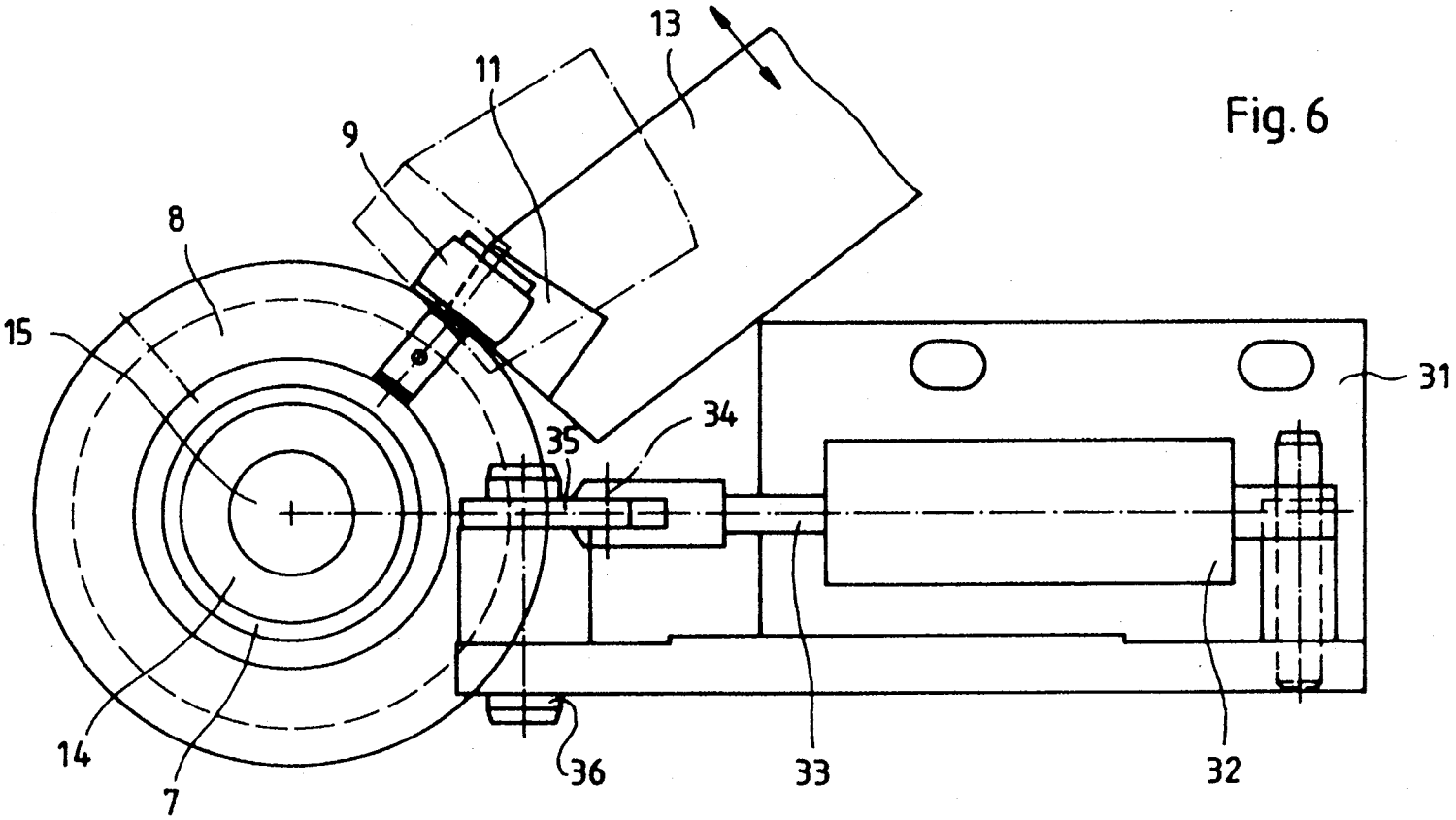
FIG. 6 is a partly diagrammatic, side elevational view of FIG. 5.

The roller 9, as shown in FIG. 6, as well as in FIGS. 1*a* and 2, is in continuous contact, by means of the compression spring 10, with an axial cam-segment disc 11 driven with a reciprocating swinging movement about a pivot pin 12 (FIG. 1*a*) of a lever 13 by a drive of the printing press, in a conventional manner. The entrainer disc 8 and, accordingly, the hollow shaft 7, the hollow shaft 14, the toothed rack 15 and the jogging plate 4 are reciprocated in axial direction towards and away from the sheet pile 3, so that the sheets deposited one on top of the other become aligned with one another by the jogging plates 4 striking against them.

When performing a sheet-size or format change, the locking or set screw 30 is loosened, first, then the handwheel 26 and the gear 24 therewith are turned so that the toothed rack 15 is shifted into the axial position thereof. If the sheet format is to be reduced, the toothed rack 15 is displaced or shifted in position thereof towards the sheet pile 3 with the entrainment of the hollow shaft 14 until the stop surface 18 of the hollow shaft 14 abuts an end face of the guide bushing 16. Upon further turning of the gear 24, the toothed rack 15 is shifted with respect to the hollow shaft 14 in the direction of the pile 3, until an end region 20 of the toothed rack 15 reaches a meshing region of the gear 24. To increase the format or size of the sheet, the gear 24 is turned in the opposite rotary direction so that, initially, the toothed rack 15 while entraining the hollow shaft 14 is shifted away from the sheet pile 3 until the stop surface 19 formed on the hollow shaft 14 abuts a non-illustrated stop formed on the end face of the hollow shaft 7 facing towards it, outside the effective range of the gear 24. If the gear 24 is turned further, the toothed rack 15 is shifted such a distance with respect to the hollow shaft 14 away from the sheet pile 3 until a sheet jogging holder 40 abuts the end face of the hollow shaft 14. After an adjustment has been made to the desired sheet size or format, the handwheel is again locked by means of the clamping screw 30. During this phase-wise entrainment of the hollow shaft 14, lower frictional forces act between the hollow shaft 14 and the hollow shaft 7 than between the hollow shaft 7 and the toothed rack 15.

The slot 28 is formed so that a shifting movement of the bearing bushing 29 with respect to the holder 27 is permitted over the entire stroke range provided for the jogging plate 4.

Figure 5:
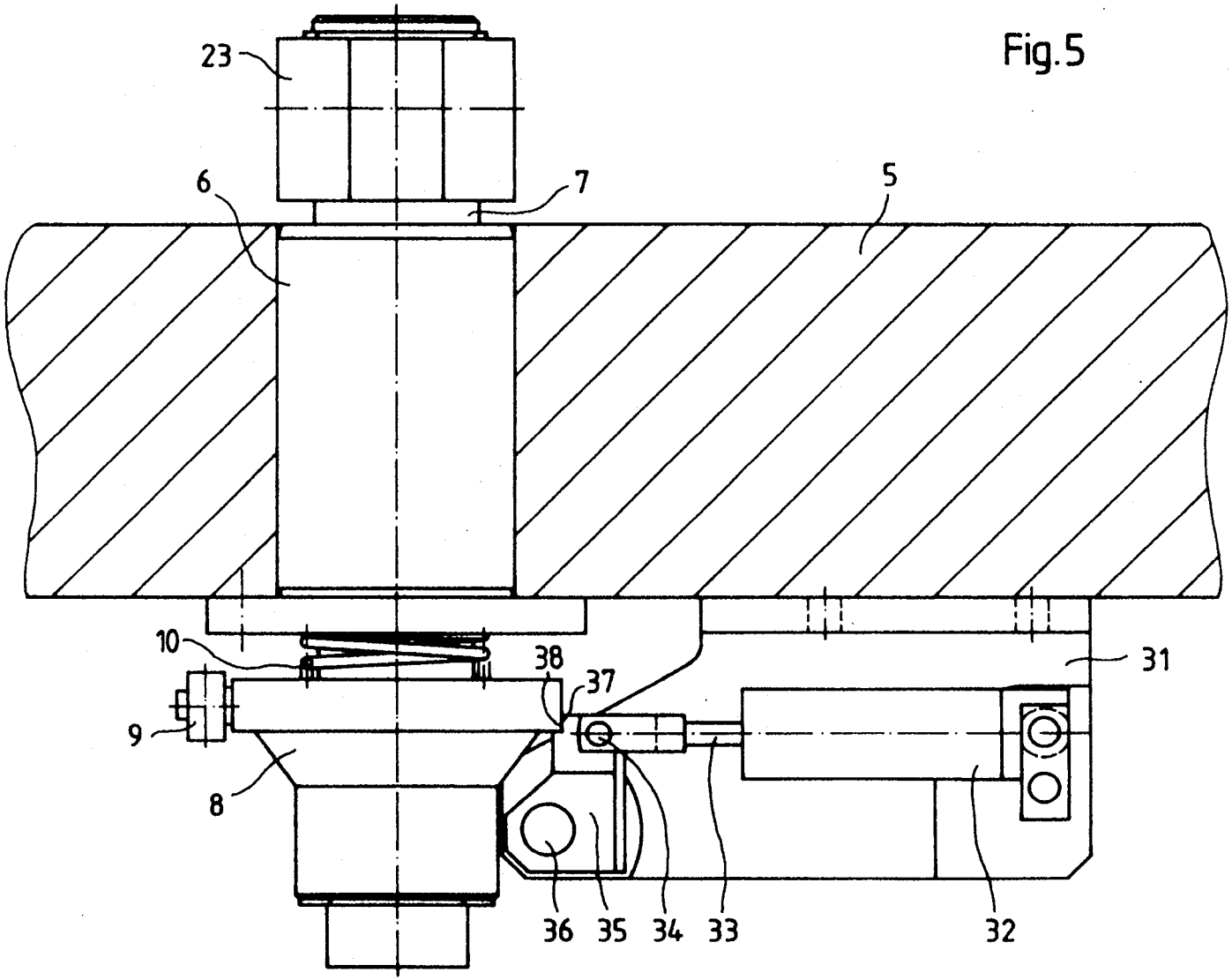
FIG. 5 is an enlarged, fragmentary top plan view, partly in section and rotated through an angle of 90 degrees, of FIG. 2, showing another embodiment of the device with a clamping device.

As is illustrated in FIGS. 5 and 6, for stopping the stroke drive, a pneumatic cylinder 32 having a piston rod 33 directed radially to the hollow shaft 7 can be fastened to the outside of the side wall 5 on a holder projection 31. A lever 35 is pivotally mounted on a bearing pin 34 carried by the piston rod 33. The lever 35 is of double-arm construction and is pivotally mounted by one of the arms thereof on a pivot pin 36 fastened to the holder projection 31. The other arm of the lever 35 is formed with a rectangularly shaped stop or abutment surface 37 which is formed of a substantially planar surface portion directed away from the side wall 5, and a substantially arcuate or correspondingly circumferential surface portion, both of the surface portions being substantially perpendicular to one another. The piston rod 33 of the pneumatic cylinder 32 can be extended when a maximum stroke of the entrainer disc 8 has occurred, which is determined by the contour of the cam-segment disc 11, the stop surface 37 of the lever 35 being thereby pressed against the stop or abutment contour of the stop surface 38 of the entrainer disc 8. This position is represented in FIG. 5. The lever 35 then acts against spring forces exerted by a compression spring 10. As the pivot lever 13 pivots further with the axial cam-segment disc 11, the latter is shifted out of contact with the cam roller 9. If desired, the jogging movements can be recommenced by retracting or driving the piston rod 33 of the pneumatic cylinder 32 back, so that the stop or abutment surface 37 of the lever 35 is shifted out of contact with the stop or abutment surface 38 of the entrainer disc 8. Due to the spring biasing force of the spring 10, the entrainer roller 9 is pressed against the cam segment disc 11 again.

Other mechanisms for switching off the jogging movement are conceivable. For example, as shown in FIG. 2, a hollow-shaft type pin or plug 41 having an end mechanically, electrically or pneumatically pressed against an end face of the entrainer disc 8 directed away from the side wall 5 can be provided, and can shift the entrainer disc 8 out of the effective range of the cam-segment disc 11.

The foregoing is a description corresponding in substance to German Application P 42 20 074.1, dated Jun. 19, 1992, the International priority of which is being claimed for the instant application, and which is hereby made part of this application. Any material discrepancies between the foregoing specification and the aforementioned corresponding German application are to be resolved in favor of the latter.

We claim:

1. Device for jogging a pile of sheets, comprising a pushrod extending in a direction towards a sheet pile, said pushrod having a thrust plate disposed on an end thereof pointing in said direction towards the sheet pile, means for holding said pushrod, said holding means being displaceable in a jogging direction, drive means connectible to said holding means for imparting a jogging movement thereto in said jogging direction, said pushrod being mounted so as to be displaceable in said direction towards the sheet pile for adjusting the position of the thrust plate relative to said holding means, said pushrod being variable in length and comprising a plurality of telescopic rods mounted so as to be displaceable in one another in said direction towards the sheet pile, means for varying the length of said pushrod and for adjusting a position of said pushrod for effecting a format adjustment, said means for varying the length of said pushrod being actuatable for, respectively, telescopically extending and retracting said telescopic rods, and means for releasably fixing said pushrod at a given length thereof.

2. Device according to claim 1, wherein said plurality of telescoping rods include an inner rod formed as a toothed rack, and an outer rod formed with a slot in vicinity of the teeth of said toothed rack, and said length varying means include a gear drive having a gear in continuous working contact with said toothed rack through said slot for forming between said inner and said outer rod a respectively releasable and restorable operative connection for entraining said outer rod.

3. Device according to claim 1, wherein said means for varying the length of said pushrod are disposed on said means for holding said pushrod.

4. Device for jogging a pile of sheets, comprising a pushrod extending in a direction towards a sheet pile, said pushrod having a thrust plate disposed on an end thereof pointing in said direction towards the sheet pile, means for holding said pushrod, said holding means being displaceable in a jogging direction, drive means connectible to said holding means for imparting a jogging movement thereto in said jogging direction, said pushrod being mounted so as to be displaceable in said direction towards the sheet pile for adjusting the position of the thrust plate relative to said holding means, said pushrod being variable in length, means for varying the length of said pushrod and for adjusting a position of said pushrod for effecting a format adjustment, and means for releasably fixing said pushrod at a respective length thereof, said pushrod comprising a plurality of telescoping rods mounted so as to be displaceable in one another in said direction towards the sheet pile, said means for varying the length of said pushrod being actuatable for, respectively, telescopically extending and retracting said telescoping rods, said plurality of telescoping rods including an inner rod formed as a toothed rack, and an outer rod formed with a slot in a vicinity of the teeth of said toothed rack, and a gear drive having a gear in continuous working contact with said toothed rack through said slot for forming between said inner and said outer rod a respectively releasable and restorable operative connection for entraining said outer rod.

* * * * *